US006328818B1

(12) United States Patent
Miyagi et al.

(10) Patent No.: US 6,328,818 B1
(45) Date of Patent: Dec. 11, 2001

(54) METHOD FOR TREATING SURFACE OF FERROUS MATERIAL AND SALT BATH FURNACE USED THEREFOR

(75) Inventors: Isao Miyagi; Wataru Taniguchi, both of Hyogo (JP)

(73) Assignee: Maizuru Corporation, Osaka (JP)

( * ) Notice: Subject to any disclaimer, the term of this patent is extended or adjusted under 35 U.S.C. 154(b) by 0 days.

(21) Appl. No.: 09/200,847

(22) Filed: Nov. 30, 1998

(30) Foreign Application Priority Data

Nov. 28, 1997 (JP) ..... 9-343734
Oct. 6, 1998 (JP) ..... 10-300365

(51) Int. Cl.[7] ..... C23C 8/26
(52) U.S. Cl. ..... 148/232; 148/209; 148/230
(58) Field of Search ..... 148/232, 209, 148/230

(56) References Cited

U.S. PATENT DOCUMENTS 4,794,044 * 12/1988 Arai et al. ..... 427/431
4,804,445 * 2/1989 Ohta et al. ..... 204/39
4,818,351 * 4/1989 Arai et al. ..... 204/39
5,230,718 * 7/1993 Oki et al. ..... 51/293
5,443,662 * 8/1995 Arai et al. ..... 148/209

FOREIGN PATENT DOCUMENTS 2518710 5/1996 (JP) .
2616814 3/1997 (JP) .

* cited by examiner

*Primary Examiner*—Roy King
*Assistant Examiner*—Nicole Coy
(74) *Attorney, Agent, or Firm*—Armstrong, Westerman, Hattori, McLeland & Naughton LLP

(57) ABSTRACT

The present invention features nitriding-treating the ferrous material to form a nitrided layer composed of at least one of iron nitride and iron carbide nitride on the surface thereof, and heating to maintain the ferrous material at a temperature of 500 to 700° C. in a treating agent (A), whereby chromium is diffused into the nitrided layer to form a compound layer composed of at least one of chromium nitride and chromium carbide nitride, wherein the treating agent (A) contains the following (a) as a main component and containing the following (b) and (c):

(a) at least one of alkali metal chloride and alkaline earth metal chloride;

(b) glass having silicone oxide as a main component; and (c) chromium.

10 Claims, 9 Drawing Sheets

X 400

METHOD FOR TREATING SURFACE OF FERROUS MATERIAL AND SALT BATH FURNACE USED THEREFOR

FIELD OF THE INVENTION

The present invention relates to a method for treating the surface of a ferrous material which stably forms a surface hardened layer such as a compound layer (hereinafter, simply referred to as "chromium carbide nitride layer") of chromium nitride or chromium carbide nitride on the surface of a ferrous material in order to improve mechanical properties such as resistance to wear, resistance to heat, resistance to oxidation, resistance to fatigue and the like, as well as to a salt bath furnace used therefor.

PRIOR APT

It is widely known that mechanical properties such as resistance to wear, resistance to heat, resistance to oxidation, and resistance to fatigue and the like can be improved by forming a chromium carbide nitride layer on the surface of a ferrous material. As such a method for forming a chromium carbide nitride layer on the surface on a ferrous material, there have been proposed various methods, for example, a plating-diffusing method and a chromizing method (JP-B 42-24967, U.S. Pat. No. 4,242,151 ) as well as a salt bath method (JP-B 3-65435, JP-B 4-24422, JP-B 4-24423, JP-B 4-47028, JP-B 4-47029, JP-A 2-159361, JP-A 3-202460).

Among the above methods, for example, a method shown in JP-B 3-65435 is a method using a salt bath or the like, in which a chromium carbide nitride layer is formed on the surface of an iron alloy material by nitriding-treating the surface of the iron alloy material to form a nitrided layer, and heat-treating the iron alloy material in the presence of a treating agent comprising ① a chromium material such as pure chromium, chromium alloy, chromium compound and the like, ② chloride, fluoride, borofluoride, oxide, bromide, iodide, carbonate, nitrate or borate or ammonium halide or metal halide of an alkali metal or an alkali earth metal to diffuse chromium.

The above methods exemplify many salts such as chloride, fluoride, borofluoride, oxide, bromide, iodide, carbonate, nitrate or borate of an alkali metal or an alkali earth metal and indicate that a chromium carbide nitride layer is formed by using them alone or in a combination thereof. However, among the respective salts, the salts other than chloride are salt bath agents which are not practically suitable at all for use in view of effects on oxidativeness of a salt bath and thermodynamic viewpoints. In addition, these salts have minus action such as conversely causing erosion of articles to be treated and the like and reversely form a chromium carbide nitride layer with difficulty.

In addition, the above methods exemplify chromium compounds such as ferrochromium as well as chloride, fluoride, oxide and the like such as $CrCl_3$, $CrF_4$, $Cr_2O_3$, $K_2CrO_3$ and the like. However, since chlorides of chromium includes many hydrates, they are disadvantageous in that they raise dew point in a salt bath. In addition, regarding fluoride and oxide, there is a problem that necessary chemical equilibrium for producing a chromium carbide nitride layer is not attained from a thermodynamic point of view. Therefore, these methods are not suitable as a treating agent for producing a chromium carbide nitride layer, being significantly problematic.

Further, in the above methods, there is described that oxides such as $Al_2O_3$, $ZrO_2$ and the like and cyanides such as NaCN and the like are added in order to adjust the viscosity of a salt bath. However, studies and experiments by the present inventors confirmed that the addition of $Al_2O_3$ and $ZrO_2$ has little effects on adjustment of a salt bath and the addition of them reversely inhibits production of a chromium carbide nitride layer. In addition, the addition of cyanide promotes nitridation and complex formation of molten chromium and an iron alloy material to produce no chromium carbide nitride layer and, additionally, since the produced complex salt tend to cause explosive burning, it is very dangerous. Thus, these methods were found not to be suitable for use.

Like this, in the prior art salt bath methods, the salt bath properties were fundamentally elucidated insufficiently. Even if a chromium carbide nitride layer could be formed on the surface of a ferrous material in laboratories, the formed layer is scattered and a salt bath life is short and, thus, the prior art methods have many problems on quality stability and economy. Therefore, a chromium carbide nitride layer can not be formed with stable quality and, thus, industrial production is not currently performed.

SUMMARY OF THE INVENTION

The present invention was done in view of such the circumstances and the object thereof is to provide a method for treating the surface of a ferrous material which can stabilize quality, prolong a salt bath life and considerably reduce a treating time, and makes industrial mass production possible, as well as a salt bath furnace used therefor.

In order to attain the above object, the present method for treating the surface of a ferrous material firstly features nitriding-treating a ferrous material to form a nitrided layer composed of at lease one of iron nitride and iron carbide nitride on the surface thereof, and heating to maintain the ferrous material at a temperature of 500 to 700° C. in an treating agent (A) below and, thereby, chromium is diffused into the nitrided layer to form at least one compound layer of chromium nitride and chromium carbide nitride.

(A) A treating agent containing the following (a) as a main component and containing the following (b) and (C):
- (a) at least one of alkali metal chloride and alkaline earth metal chloride;
- (b) glass having silicone oxide as a main component; and
- (c) chromium.

The present method for treating the surfaces of a ferrous material secondly features nitriding-treating a ferrous material to form a nitrided layer composed of a nitrogen-diffused layer on the surface thereof, and heating to maintain the ferrous material at a temperature of 500 to 700° C. in the above treating agent (A) and, thereby, chromium is diffused into the nitrided layer to form a chromium-concentrated layer.

Also, in order to attain the above object, the present salt bath furnace features a salt bath furnace for conducting molten salt bath treatment which comprises a treating cell in which the treating agent is introduced, a heating means for heating to melt the treating agent in the treating cell, and a stirring means for stirring the treating agent which has been melted in the treating cell, wherein the bottom of the treating cell has a slant surface, and the stirring means is provided in a deep portion lower than the slant surface of the bottom of the treating cell.

In order to produce a surface hardened layer such as a chromium carbide nitride layer and the like having industrially stable and high quality, the present inventors, in process of a series of studies, paid an attention to that it is important to appropriately control basicity of a salt bath and maintain thermodynamic activity and equilibrium of chromium ions in a salt bath in order to produce a stable chromium carbide nitride layer by salt bath treatment. Subsequently, we found that basicity of a salt bath can be appropriately maintained by inclusion of glass powders having silicon oxide as a main component in a salt bath containing as a main component at least one of alkali metal chloride and alkaline earth metal chloride as a main component and containing chromium, which resulted in completion of the present invention.

Then, mode for carrying out the present invention will be explained in detail.

In the present invention, a ferrous material is nitriding-treated to form a nitrided layer composed of at lease one of iron nitride and iron carbide nitride on the surface thereof, and the ferrous material is heated to maintain at a temperature of 500 to 700° C. in an treating agent containing as a main component at least one of alkali metal chloride and alkaline earth metal chloride and containing silicon oxide as a main component and chromium and, thereby, chromium is diffused into the nitrided layer to form at least one compound layer of chromium nitride and chromium carbide nitride.

Subject ferrous materials in the present invention are not limited to specified ones and various materials are used. Examples thereof are machine structural carbon steel such as nickel-chromium steel, nickel-chromium-molybdenum steel, chromium steel, chromium-molybdenum steel and the like, spring steel such as manganese-chromium steel, chromium-vanadium steel, silicon-manganese steel and the like, tool steel such as high carbon chromium steel, tungsten-chromium steel, tungsten-vanadium steel and the like, high speed steel such as tungsten-chromium-vanadium steel and the like, as well as various alloy steels such as manganese steel, H steel, nitrided steel, high strength steel, free cutting steel, dies steel, bearing steel, heat-resistant steel, boron steel and the like, and various cast iron, cast steel and the like. In addition besides steels, mention may be made of industrial pure iron containing little carbon or carburized pure iron, carbon steel and the like. Further, besides steel made by melting, mention may be made of sintered alloy obtained by powder metallurgy method. These may be pre-treated by various heat-treatments such as hardening, tempering, normalizing, annealing and the like depending upon use object.

In the present invention, nitriding-treatment is first made on the ferrous material to form a nitrided layer composed of at least one of iron nitride and iron carbide nitride on the surface thereof. A nitriding method is not limited to specified one and may be conducted by various methods. For example, there are various methods such as a salt bath nitriding method, a salt bath soft-nitriding method, a gas nitriding method, a gas soft-nitriding method, an ion-nitriding method, a carbo-nitriding method, an oxy-nitriding method, a conjugated treating method which combines fluorination and soft-nitriding. Conditions under which various nitriding treatments are performed are different depending upon a nitriding method to be used, and may be any ones as long as a nitrided layer having a predetermined thickness is formed on the surface of a ferrous material, but are not limited thereto.

Inter alia, among the above nitriding methods, a conjugated treating method which combines fluorination and gas soft-nitriding is suitably performed where a ferrous material is pre-heated and maintained in fluoro-gas atmosphere to form a fluoride layer on the surface thereof, which is then heated in nitriding atmosphere to form a nitrided layer.

Mention may be made of a fluorine compound gas comprising $NF_3$, $BF_3$, $CF_4$, $F_2$, $SF_6$, $C_2F_6$, $WF_6$, $CHF_3$, $SiF_4$ and the like as a fluoro-gas in the above conjugated treating method. These gases may be used alone or in a combination thereof. Besides them, other fluorine compound gases containing F in the molecule and $F_2$ gas which is produced by thermally decomposing the above fluoro-gases with a thermally decomposing apparatus or pre-produced $F_2$ gas may be used. Such the fluorine compound gases and $F_2$ gas may be mixed to use in some cases. Fluoro-gases such as the above fluorine compound gases, $F_2$ gases and the like may be used alone but, usually, may be used by diluting with an inert gas such as $N_2$ gas and the like. The concentration of the fluoro-gas itself in such the diluted gas is, for example, 10000 to 100000 ppm, preferably 20000 to 70000 ppm, more preferably 30000 to 50000 ppm. The most practical fluoro-gas is $NF_3$ since the $NF_3$ is gaseous at normal temperature, is high in chemical stability and is easy to handle.

A ferrous material is retained in the heated state under fluoro-gas atmosphere having the above concentration to conduct the fluorinating treatment. In this case, a heating temperature is set at a temperature, for example, of 300 to 550° C. And, a heating retaining time may be appropriately set depending upon a kind of articles, size and dimension of articles, heating temperature and the like and, usually, set for a period of ten and several minutes to tens of minutes. By fluorination-treating a ferrous material under such the fluoro-gas atmosphere, "N" atoms become easy to permeate from the surface of a ferrous material into the interior thereof. This is because an oxide layer or the like such as FeO, $Fe_3O_4$, $Cr_2O_3$ or the like is formed on the surface of a ferrous material and, when the ferrous material on which the oxide layer or the like has been formed is fluorination-treated as described above, the oxide is reacted with fluorine gas and activated by being converted into a thin fluorinated layer containing a compound such as $FeF_2$, $FeF_3$, $CrF_2$, $CrF_4$ and the like, which leads to the surface state where "N" atoms are easy to permeate. Therefore, when the ferrous material having the surface state where "N" atoms are easy to permeate is heated and maintained in nitriding atmosphere as described below, "N" atoms in a nitriding gas is considered to diffuse uniformly into the ferrous material from the surface into a predetermined depth, leading to formation of a deep and uniform nitrided layer. During this process, the fluorinated layer is decomposed and deleted.

The ferrous material in the state where "N" atoms are easy to permeate as described above is then retained in the heated state in nitriding atmosphere to be gas soft-nitriding-treated. In this case, as a nitriding gas for making the nitriding atmosphere, a single gas comprising only $NH_3$ is used. Alternatively, a mixed gas having $NH_3$ and a carbon source (for example, RX gas), for example, a mixed gas of $NH_3$, CO and $CO_2$ may be used. Also, both may be mixed for use. Usually, the single gas or the mixed gas is used by mixing with an inert gas such as $N_2$ or the like. Occasionally, these games may be used by further mixing with $H_2$ gas. As the nitriding treatment, a heating temperature is usually set at a temperature of 350 to 650° C., preferably 500 to 580° C., and a nitriding-treating time is usually set for a period of one hour to tens of hours, preferably one to ten hours.

According to this conjugated treatment of fluorination and gas soft-nitriding, there is an advantage in that adsorption and diffusion of N onto the surface of a ferrous material is carried out uniformly and rapidly and nitriding is uniformly carried out to form a uniform nitrided layer and, at the same time, since formation of a porous layer is low, a chromium carbide nitride layer having excellent durability is obtained.

By diffusing nitrogen into the surface of a ferrous material by means of these nitriding-treating methods, a nitrogen compound layer composed of at least one of iron nitride and iron carbide nitride is formed on the upper most surface thereof. In the present invention, these nitrogen compound layer and nitrogen-diffused layer are collectively referred to as a nitrided layer. That is, FIG. 6 shows a cross-sectional hardness distribution of the surface layer portion of a ferrous material after nitriding treatment and, in the figure, the hardest layer of the surface is a nitrogen compound layer composed of iron carbide nitride and the like and a portion under the nitrogen compound layer (right side in the figure) where hardness is gradually reduced is a nitrogen-diffused layer. The thickness of the nitrided layer which are formed by the various nitriding methods is different depending upon a kind of used ferrous material and a kind of steel. That is, in a case of plain steel (S10C–S55C, SPCC, SMn, SK1–SK7, SS material, FC, FCD and the like), the thickness of the nitrogen compound layer is around 15 to 25 $\mu$m and that of the nitrogen-diffused layer is 300 to 600 $\mu$m, and surface hardness is around Hv400–700. In a case of low alloy steel (SCM, SNC, SNCM, SCr and the like), the thickness of the nitrogen compound layer is around 5 to 15 $\mu$m and that of the nitrogen-diffused is 100 to 300 $\mu$m, and surface hardness is around Hv 600 to 900. In addition, in a case of high alloy steel (SKD, SKS, SKH and the like), the thickness of the nitrogen compound layer is around 2 to 10 $\mu$m and that of the nitrogen-diffused layer is 50 to 100 $\mu$m, and surface hardness is around Hv 800 to 1200. When the thickness of the nitrogen compound layer is less than the above respective values, the thickness of the formed chromium carbide nitride layer becomes thinner. When the thickness exceeds the above respective values, it takes a longer time for nitriding treatment itself, leading to higher cost and causing increase in porous layers and in surface roughness, which may deteriorates mechanical properties.

In the present invention, the ferrous material after the nitriding treatment is retained by heating in an treating agent containing as a main component at least one of alkali metal chloride and alkaline earth metal chloride and containing glass having silicon oxide as a main component and chromium.

Examples of the alkali metal chloride include LiCl, NaCl, KCl, RbCl and CsCl and examples of the alkaline earth metal chloride include $BeCl_2$, $MgCl_2$, $CaCl_2$, $SrCl_2$, $BaCl_2$ and $RaCl_2$. These may be used alone or in a combination thereof. These are used mainly as powders or particles and suitably heated to melt into a salt bath for easy handling. These are materials for salt bath treatment and also serves as a medium for diffusing chromium into the surface of a ferrous material upon the salt bath treatment.

As the chromium, industrial metal chromium is used. This metal chromium may be used in the various forms such as powders, particles, fibers or the like. Particularly, powders are suitably used since they are cheap due to easy availability and dissolution and mixing into a salt bath may be easily conducted. The particle size of the powders is preferably not greater than 50 mesh. When the size is not greater than 200 mesh, it is more suitable, when the size exceeds 50 mesh, since dissolution and dispersion into a salt bath can not be uniformly carried out, it becomes difficult to produce a stable chromium carbide nitride layer. In addition, besides powders and the like, rod-like and plate-like chromium materials may be immersed into a molten salt bath as a cathode to electromelt. The chromium is melted into the salt bath to diffuse into a nitrided layer on the surface of a ferrous material, which substitutes iron in the nitrided layer, leading to formation of a chromium carbide nitride layer and the like.

The content of chromium in the treating agent is preferably 3 to 30% by weight, more preferably 15 to 20% by weight. When the content is less than 3% by weight, substitution reaction of chromium with iron is difficult to occur and it becomes difficult to form a chromium carbide nitride layer and the like. When the content exceeds 30% by weight, undissolved chromium accumulates in a treating cell to limit the effects and, since flowing properties of a salt bath become deteriorated, it becomes difficult to form a uniform compound layer. In addition, since attachment of the treating agent to the article to be treated is increased, lost of weight is increased, resulting in very uneconomical result.

The glass having silicon oxide as a main component is not limited to specified ones, and any glasses may be used so long as they contain silicon oxide ($SiO_2$) as a main component. Examples thereof are various silicate glasses such as silicate glass, silicate alkali glass, soda-lime glass, potassium-lime glass, lead glass, barium glass, borosilicate glass and the like, as well as industrial pure silicon oxide and the like. These may be used alone or in a combination thereof. The content of silicon oxide which is a main component is preferably not less than 80% by weight, more preferably not less than 95% by weight. When the content is less than 80% by weight, incorporation of other impurities grows greater, the effects of stabilizing basicity of a salt bath are lowered and, since activation of chromium ions is adversely affected, it becomes difficult to form a chromium carbide nitride layer and the like. Inter alia, among them, pure silicon oxide having purity of not less than 99% by weight is particularly suitably used due to remarkable manifestation of stabilization of basicity as well as easy availability and easy handling.

In addition, the glass having silicon oxide as a main component may be used in the form of powders, particles, fibers, liquid or the like. Particularly, powders are suitably used due to easy availability, uniform mixing into the treating agent and easy handling. The particle size of powders in the salt bath is preferably not greater than 1000 $\mu$m, more preferably not greater than 50 $\mu$m. When the size exceeds 1000 $\mu$m, the powders become difficult to be uniformly dispersed into the treating agent and, additionally, massy silicon oxide is attached to articles to be treated, resulting in cause of treatment scatter.

The glass having silicon oxide as a main component may be contained in a salt bath comprising chlorine of an alkali metal and the like and chromium in order to stabilize basicity of a salt bath to thermodynamically maintain and enhance the chromium ion activity, leading to stable production of a chromium carbide nitride layer and the like.

The content of the glass having silicon oxide as a main component in the treating agent is preferably 1 to 40% by weight, more preferably 10 to 20% by weight. When the content is less than 1 by weight, the effects of stabilizing basicity resulting from the addition of silicon oxide are not sufficiently attained and, thus, it becomes difficult to form a chromium carbide nitride layer and the like. On the other hand, when the content exceeds 40% by weight, the viscosity of a salt bath becomes too high, which increases lost of weight of the treating agent and which becomes cause of treatment scatter, choking and the like.

Compounds such as metal carbide, alkali metal carbide, alkaline earth metal carbide, alkali metal hydride, alkaline earth metal hydride, alkali metal hydroxide, alkaline earth metal hydroxide, alkali metal oxide, alkaline earth metal oxide, silicon powders, manganese powders and the like may be added to the treating agent. These may be used alone or in a combination thereof.

Inter alia, among the respective compounds, metal carbide, alkali metal carbide, alkaline earth metal carbide, alkali metal hydride, alkaline earth metal hydride, alkali metal hydroxide, alkaline earth metal hydroxide, alkali metal oxide and alkaline earth metal oxide are particularly suitably used. These may be used alone or in a combination thereof. Inclusion of these compounds can further stabilize basicity of a salt bath, stabilize formation of a chromium carbide nitride layer and the like and accelerate its growth rate to economically obtain a compact and good chromium carbide nitride layer and the like.

Inter alia, among the respective compounds, metal carbide, alkali metal carbide, alkaline earth metal carbide, alkali metal hydride, alkaline earth metal hydride, alkali metal oxide, alkaline earth metal oxide, silicon powders and manganese powders are particularly suitably used. These may be used alone or in a combination thereof. The addition of these compounds maintains the concentration of oxygen is dissolved in a salt bath from atmosphere at low level, which stabilizes basicity of a salt bath for a longer period of time, maintains stable production of a chromium carbide nitride layer and the like for a long period of time and prolongs a salt bath life.

Examples of the metal carbide include, but are not limited to, various metal carbides such as $Cr_3C_2$, $Cr_{23}C_6$, $Cr_7C_3$, $Fe_3C$, TiC, $Co_3C$, MoC, $Mo_2C$, $W_2C$, WC, NbC, TaC, VC, ZrC, $Mn_3C$, $Mn_{23}C_6$, $Mn_7C_3$ and the like. These may be used alone or in a combination thereof. Among them, TiC and VC are particularly effective.

Examples of the alkali metal carbide include $Li_2C_2$, $Na_2C_2$, $K_2C_Z$, $RbC_5$, $RbC_{16}$, $CsC_9$, $CsC_{16}$ and the like, and examples of the alkaline earth metal carbide include $Be_2C$, $MgC_2$, $Mg_2C_3$, $CaC_2$, $SrC_2$, $BaC_2$ and the like. These may be used alone or in a combination thereof. Among them, $CaC_2$ is particularly effective.

Examples of the alkali metal hydride are LiH, NaH, KH, RbH and CsH and examples of the alkaline earth metal hydride are $BeH_2$, $MgH_2$, $CaH_2$, $SrH_2$, $BaH_2$ and $RaH_2$. These may be used alone or in a combination thereof. Among them, $CaH_2$ is particularly effective.

Examples of the alkali metal hydroxide are LioH, NaOH, KOH, RbOH and CsOH and examples of the alkaline earth metal hydroxide are $Be(OH)_2$, $Mg(OH)_2$, $Ca(OH)_2$, $Sr(OH)_2$, $Ba(OH)_2$ and $Ra(OH)_2$. These may be used alone or in a combination thereof. Among them, NaOH, KOH and $Ca(OH)_2$ are particularly effective.

Examples of the alkali metal oxide are $Li_2O$, $Na_2O$, $K_2O$ and the like, and examples of the alkaline earth metal oxide are MgO, CaO, SrO, BaO and the like. These may be used alone or in a combination thereof. Among them, CaO is particularly effective.

Among the respective compounds, at least one of alkali metal carbide, alkaline earth metal carbide, alkali metal hydroxide, alkaline earth metal hydroxide, alkali metal oxide and alkaline earth metal oxide is contained in the treating agent preferably at a total amount of 0.01 to 10% by weight, more preferably 0.1 to 2.0% by weight. When the total amount is less than 0.01% by weight, since the effects of adjusting basicity and oxygen concentration of a salt bath are lowered, it becomes difficult to form a chromium carbide nitride layer and the like. When the total amount exceeds 10% by weight, the viscosity of a salt bath becomes too high, which increases lost of weight of the treating agent and makes easy to cause treatment scatter and choking to occur.

Among the respective compounds, at least one of metal carbide, alkali metal hydride, alkaline earth metal hydride, silicon powders and manganese powders is contained in the treating agent preferably at a total amount of 0.0001 to 1% by weight, more preferably 0.001 to 0.01% by weight. When the total amount is less than 0.0001% by weight, since the effects of adjusting basicity and oxygen concentration of a salt bath are lowered, chromium ionization is inhibited, which makes difficult to form a chromium carbide nitride layer and the like. When the total amount exceeds 1% by weight, the ion concentration of the additives becomes too high and a harmful effect of the additives themselves reacting with nitrogen arises, which gives minus effects to formation of a chromium carbide nitride layer and the like.

Figure 1:
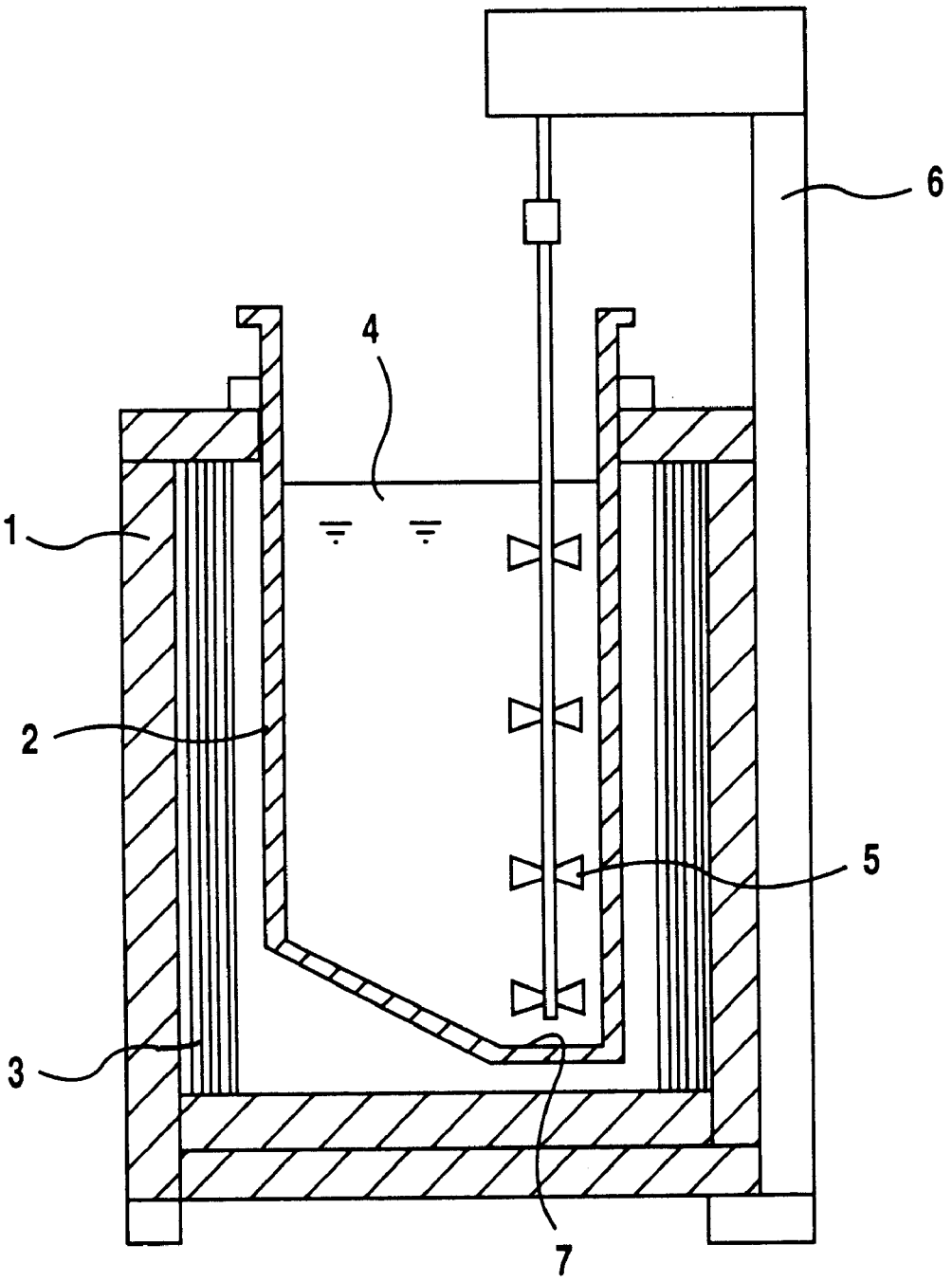
FIG. 1 is a cross-sectional view showing a salt bath of the present invention.

The method for surface-treating method of the present invention may be carried out, for example, in a salt bath furnace shown in FIG. 1 using the above treating agent. This salt bath furnace is provided with a square pole-like treating cell 2, having the bottom, into which a treating agent 4 is introduced into the interior of a furnace body 1 which covers the outside of a furnace. A heater 3 for heating the treating cell 2 from the outside to heat and melt the treating agent 4 in the treating cell 2 is provided in a gap between the furnace body 1 and the treating cell 2. In addition, an impeller 5 for stirring the treating agent 4 which has been melted in the treating cell 2 is charged into the treating cell 2. In the figure, 6 is a means for holding the impeller 5. The bottom of the treating cell 2 is composed of an one-hardly and downwardly slant surface and a lower end of the impeller 5 is positioned at a deep portion 7 lower than a slant surface of the bottom of the treating cell 2. The treating cell 2 may be composed of cast iron, carbon steel, ferristic stainless steel or austenitic stainless steel, however most preferably, be composed of a nickel alloy such as inconel (inconel 600), Hastelloy, monel, Illium and the like in viewpoints of corrosion resistance and the like.

According to the salt bath furnace, since the bottom of the treating cell 2 is an one-wardly and downwardly slant surface and a lower end of the impeller 5 is provided at a deep portion 7 lower than a slant surface of the bottom of the treating cell 2, when the molten salt bath treatment is carried out with a treating agent 4 containing metal powders such as chromium and the like, the metal powders tend to gather at the deep portion 7. Since gathered metal powders are stirred such that they are drawn up with a impeller 5, there is an advantage that the efficacy of stirring the treating agent in the treating cell 2 is improved and the salt bath treatment is made uniform and stabilized. In addition, in case that the treating cell 2 is made of a nickel alloy, there is an advantage that the cell is difficult to be attacked with the treating agent 4 and the material for forming the cell 2 is difficult to be dissolved into the treating agent 4 as impurities, which makes possible lasting stable treatment.

The above treating cell 2 may wholly be made of a nickel alloy, or only the interior thereof may be lined with a nickel alloy. Although the above bottom of the treating cell 2 is an one-wardly and downwardly slant surface, earthenware mortar-like slant may be provided or such slant may be provided that a corner portion of square pole-like treating cell 2 is the deepest. Anyhow, only if a lower end of the impeller 5 is provided at a deep portion, the similar effects are obtained. Although the salt bath furnace in FIG. 1 uses an impeller 5 as a stirring means, the stirring means is not limited thereto but includes various type stirrers such as a pump-type stirrer which draws a salt bath agent up to stir, a rocking type stirrer which rocks an agitating blade to stir, a blowing type which stirs by blowing gas and the like may be used. Especially, in case that the blown gas is at least one gas of inert gases such as nitrogen, argon and helium, hydrogen, chlorine and hydrogen chloride in the blowing type, the oxygen concentration in the treating agent 4 can be decreased and chromium ion can be activated. Thus, a compact and good chromium carbide nitride layer and the like is formed and, at the same time, a forming rate of a chromium carbide nitride layer and the like becomes higher, which makes it possible to maintain much economic productivity. In addition, gas-blowing stirs the treating agent 4, so that the metal powders having large gravity easily to gather at the deep portion 7 such as chromium can be scattered uniformly and temperature distribution of the treating agent 4 becomes uniform. As a result, variation of the molten salt bath treatment becomes small and mechanical accuracy such as thermal distortion and surface roughness of ferrous material to be treated in the molten salt bath is improved, resulting in improvement in commercial value. Although the treating cell 2 is square pole-like, the shape thereof is not limited thereto but various shapes such as cylindrical, hexagonal pole-like and the like may be used. These give the similar effects.

In the present invention, for example, the treatment of the surface of a ferrous material is carried out using the above salt bath furnace as follows: Chloride of alkali metal or the like, glass having silicon oxide as a main component and chromium are first mixed at a predetermined ratio to prepare a treating agent. To this treating agent are added compounds such as metal carbide, carbide, hydride, hydroxide and oxide of alkali metal and the like, as well as silicon powders, manganese powders and the like.

Then, the treating agent thus prepared is introduced into the treating cell 2 of the salt bath furnace, which is heated to melt with a heater 3 to prepare a salt bath. Then, a ferrous material on which a nitrided layer has been formed is immersed in the salt bath and heated to retain for a predetermined period of time. A heating temperature upon this is preferably set at 500 to 700° C. When a temperature is not greater than 500° C., the treating effects become lower and, thus, it becomes difficult to form a stable chromium carbide nitride layer. Additionally, since the treating agent 4 is not melted, it becomes difficult to conduct the salt bath treatment. On the other hand, a temperature exceeds 700° C., erosion of the treating cell 2 becomes severer and a ferrous material is softened, leading to lower strength. A treating time is different depending upon a treating temperature, thickness of a chromium carbide nitride layer to be formed and the like and is approximately one hour to ten and several hours.

By conducting the salt bath treatment like this, chromium which has been melted into the treating agent is diffused into a nitrided layer of the surface of a ferrous material which has been pre-formed by the nitriding treatment, to occur a reaction substituting iron in the nitrided layer with chromium, as described below.

Figure 2:
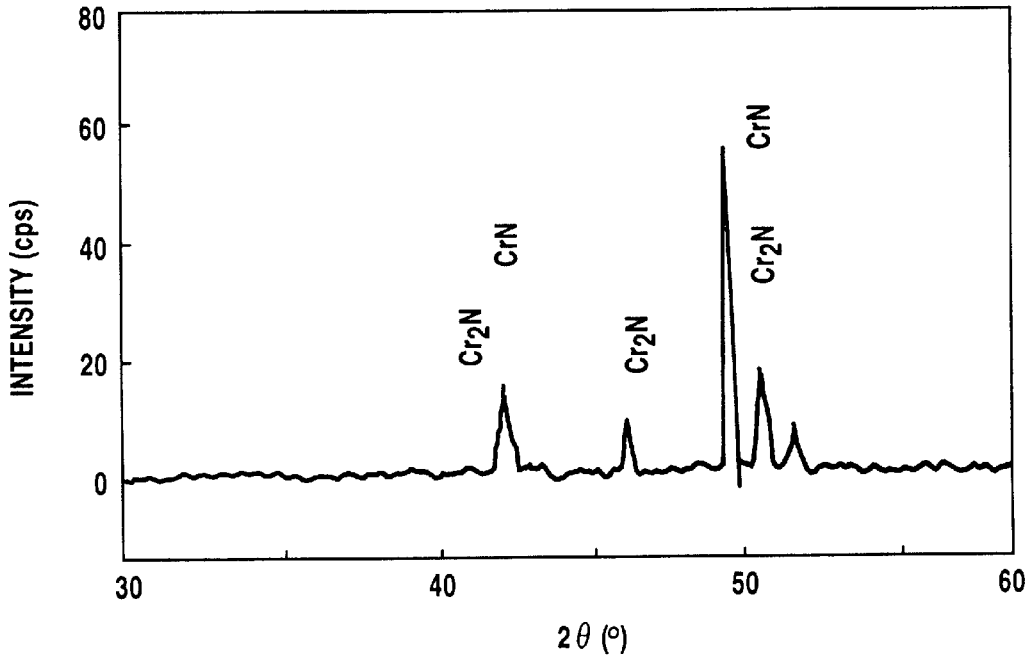
FIG. 2 is the results of x-ray diffraction on a ferrous material which was treated by the surface-treating method of the present invention.

First, in a case of a nitrided layer where a nitrogen compound layer of iron nitride or iron carbide nitride is formed on the surface, the iron nitride and iron carbide nitride are gradually changed into chromium nitride and chromium carbide nitride starting at the surface by a reaction substituting chromium with iron. In a shorter treating period of time, a proportion of chromium nitride and chromium carbide nitride is large in the vicinity of the surface of a nitrogen compound layer and a proportion of iron nitride and iron carbide nitride is large at the vicinity of a matrix. As the treatment is continued, finally, a compound layer containing only chromium nitride and chromium carbide nitride and containing little iron nitride and iron carbide nitride is formed. The compound layer obtained described above was subjected to X-ray diffraction and the results thereof are shown in FIG. 2. From this X-ray diffraction, peaks of Cr (N,C) and $Cr_2$ (N,C) are clearly discerned and it is seen that the compound layer is chromium carbide nitride. Additionally describing, a chromium nitride layer formed by the present treating method includes not only the state of chromium nitride and chromium carbide nitride containing little iron nitride and iron carbide nitride but also the state where iron nitride and iron carbide nitride are present in the vicinity of a matrix.

By the above salt bath treatment, chromium diffuses not only into a nitrogen compound layer but also into a nitrogen diffused layer present below the nitrogen compound layer. That is, describing a case of iron nitride, the above nitrogen compound layer is mainly composed of compounds such as $Fe_3N$, $Fe_4N$ and the like, and the nitrogen-diffused layer is considered that Fe and $Fe_4N$ are present in a mixed state. By the salt bath treatment, chromium is diffused not only into the nitrogen compound layer but also into the nitrogen-diffused layer there below, and a reaction occurs substituting Fe in the nitrogen-diffused layer where Fe and $Fe_4N$ are present in the mixed state with chromium, which changes the nitrogen-diffused layer into a chromium-rich material.

Figure 7:
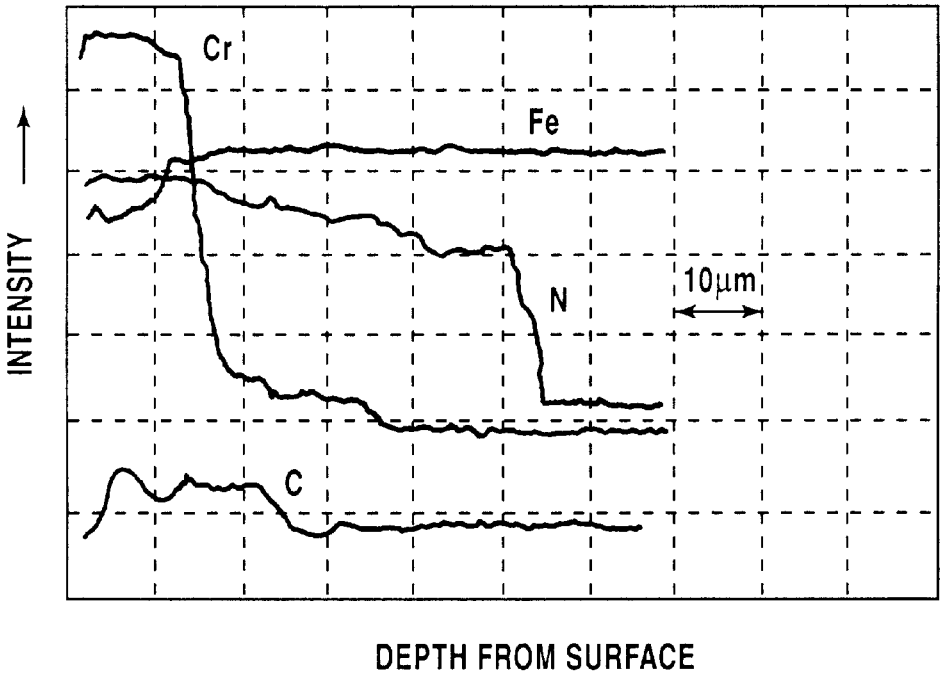
FIG. 7 is a diagram showing the results of EPMA analysis on a sample on which a nitrogen-diffused layer was formed and which was salt bath-treated.
Figure 8:
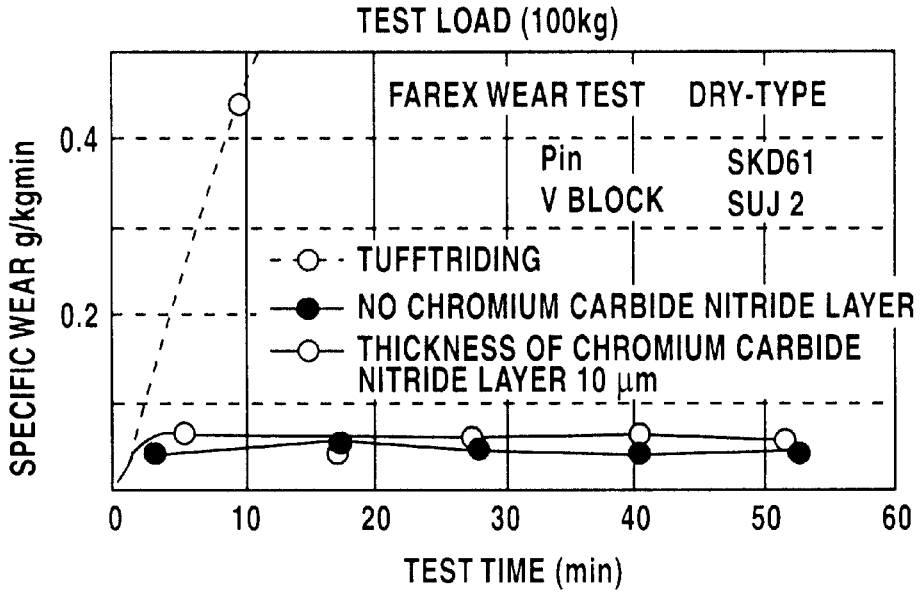
FIG. 8 is a graph showing the results of a wear test.

Further, according to the present invention, the nitriding treatment is carried out under the conditions where a nitrogen compound layer is not formed but a nitrided layer of only nitrogen-diffused layer is formed, or a nitrided layer composed of a nitrided compound layer and a nitrogen-diffused layer is formed and then the nitrogen compound layer on the surface is removed by mechanical processing (polishing, shot peening or the like), chemical polishing (immersion in acid or the like) or the like, leaving only the nitrogen-diffused layer and, thereafter, chromium may be diffused from the surface to improve mechanical properties such as resistance to wear, resistance to oxidation, resistance to fatigue and the like. In these cases, the aforementioned chromium carbide nitride layer is not formed but a reaction occurs substituting Fe in a nitrogen-diffused layer with chromium, which leads to a chromium-rich material. FIG. 7 shows the results of EPMA analysis on the surface part of a sample obtained by forming only a nitrogen-diffused layer and then diffusing chromium by the salt bath treatment. As apparent from FIG. 7, it is seen that chromium is diffused, at a high concentration, into the surface portion of a nitrogen-diffused layer having high concentration of nitrogen and, thus, a so-called chromium-concentrated layer is formed. The results of Farex wear test on a sample on which a chromium carbide nitride layer is formed and a sample on which a chromium carbide nitride layer is not formed but a chromium-concentrated layer is formed are shown in FIG. 8. As a comparative sample, a tufftriding-treated sample was used. As apparent from FIG. 8, it is seen that a sample on which a chromium carbide nitride layer is not formed but a chromium-concentrated layer is formed can also afford very high resistance to wear equal to that of a sample on which a chromium carbide nitride layer is formed.

In a case where a chromium carbide nitride layer is not formed but a chromium-concentrated layer is formed, it is effective in a mold on which remarkably high impact load or bending load is applied, or in treatment of ferrous steel parts, which results in very effective means for improving mechanical properties such as resistance to wear, resistance to heat and the like, and preventing development of crack, fracture and the like. In addition, it is effective in making parts requiring high precision. That is, high precision parts having high resistance to wear can be made by, after nitriding treatment, conducting machine finish at high precision by polishing or the like and, thereafter, diffusing chromium using a salt bath.

In the present invention, since glass having silicon oxide as a main component is contained in a treating agent, the aforementioned formation of the chromium carbide nitride layer and diffusion of chromium into a nitrogen-diffused layer are stabilized. Although the reasons are not necessarily clear at present, it is considered that, in a salt bath of chloride such as an alkali metal and the like, a part of the silicon oxide forms $xNaOySiO_2$, which functions to retain stable basicity of a salt bath stable and, at the same time, a part thereof is ion-dissociated, which functions to prevent excess oxidation of ionized chromium. That is, inclusion of the silicon oxide can attain stabilization of basicity of a salt bath and, thus, silicon oxide is one kind of additives which are essential for permitting a stabilized chromium carbide nitride layer and the like to be produced by a salt bath method.

In addition, in a salt bath, oxygen and moisture in the atmosphere are dissolved therein in course of time, and basicity is lowered and oxidativeness is raised and, at the same tine, chromium in the treating agent is oxidized and consumed. With lowered basicity, a chromium carbide nitride layer and the like formed by the surface treatment becomes gradually thinner and, when oxidativeness is further progressed, no compound layer and the like is produced, which causes rough skin-like erosion on the surface of a ferrous material. That is, in order to stably produce a good chromium carbide nitride layer and the like, it is required that basicity of a salt bath is maintained high and oxygen concentration is maintained low. Therefore, in order to stably conduct the salt bath treatment, basicity and oxygen concentration of a salt bath are required to be usually regulated at the appropriate state.

By conducting at least one of including at least one of metal carbide, alkali metal carbide, alkaline earth metal carbide, alkali metal hydride, alkaline earth metal hydride, alkali metal hydroxide, alkaline earth metal hydroxide, alkali metal oxide and alkaline earth metal oxide in a treating agent and blowing at least one gas of inert gas such as nitrogen, argon and helium, hydrogen, chlorine and hydrogen chloride, basicity of a salt bath is further stabilized, a compact and good chromium carbide nitride layer and the like is formed and, at the same time, a forming rate of a chromium carbide nitride layer and the like becomes higher, which makes it possible to maintain much economic productivity.

Further, by inclusion of at least one of metal carbide, alkali metal carbide, alkaline earth metal carbide, alkali metal hydride, alkaline earth metal hydride, silicon powders and manganese powders in the treating agent, the oxygen concentration in the salt bath can be retained low. That is, regarding chromium which easily forms an oxide, the concentration of oxygen which dissolves in the treating agent from the atmosphere can be retained low, which stabilizes basicity over a much longer period of time, stably produces a chromium carbide nitride layer and the like over a long period of time, and prolongs a salt bath life. Although the reasons therefor are not necessarily clear, it is presumed due to that metals such as alkali metal, alkaline earth metal, silicon, manganese and the like have higher binding ability with oxygen as compared with chromium.

In the present invention, in a case where a chromium-plated layer is formed on the surface of a ferrous material after the nitriding treatment and then the salt bath treatment is conducted, it is not necessarily required that a treating agent contains the chromium. That is, by the salt bath treatment, chromium in a chromium-plated layer is diffused into a nitrided layer, which leads to formation of a chromium carbide nitride layer and the like.

In the foregoing mode for carrying out the invention, a case of so-called molten salt bath treatment where a ferrous material is immersed by heating to melt a treating agent has been described. However, the present invention is not limited thereto but can be carried out by various methods such as a so-called molten salt electrolysis method by immersing a ferrous material as a cathode into the aforementioned molten salt bath, by a so-called powder pack method by retaining a ferrous material in a treating agent in the powdery state to heat, by a so-called paste method by mixing a powdery treating agent with a binder to obtain a paste which is coated on an area of a ferrous material to be treated and heated, or a so-called fluidized bed method by filling a fluidized bed furnace with a powdery treating agent, blowing gas therein to fluidize, and then holding a ferrous material to heat therein. These respective methods can afford the similar advantages to those described above.

Effects of the Invention

As described above, in the present invention, a ferrous material on which a nitrided layer has been formed is retained to heat in a treating agent containing either one of alkali metal chloride and alkaline earth metal chloride as a main component and containing glass having silicon oxide as a main component and chromium. This diffuses chromium into a nitrided layer to form a compound layer of chromium nitride or chromium carbide nitride. Upon this, by means of the function of silicon oxide contained in the treating agent, basicity of a salt bath is stabilized and a uniform and compact chromium carbide nitride layer and the like can be formed in a shorter period of time as compared with the prior art and, further, chromium carbide nitride layer and the like can be stably formed, which makes possible industrialization which has previously never attained.

Then, Examples will be explained.

(1) A nitride layer

EXAMPLE 1

COMPARATIVE EXAMPLE 1 AND COMPARASION 1

The surface treatment of the present invention was carried out using a test piece of SKD61 material under the following conditions. The thickness of a chromium carbide nitride layer of a test piece which had been surface-treated under each condition was measured. A relationship between the thickness of a chromium carbide nitride layer and a salt bath treating time upon this is shown in FIG. 3.

Figure 3:
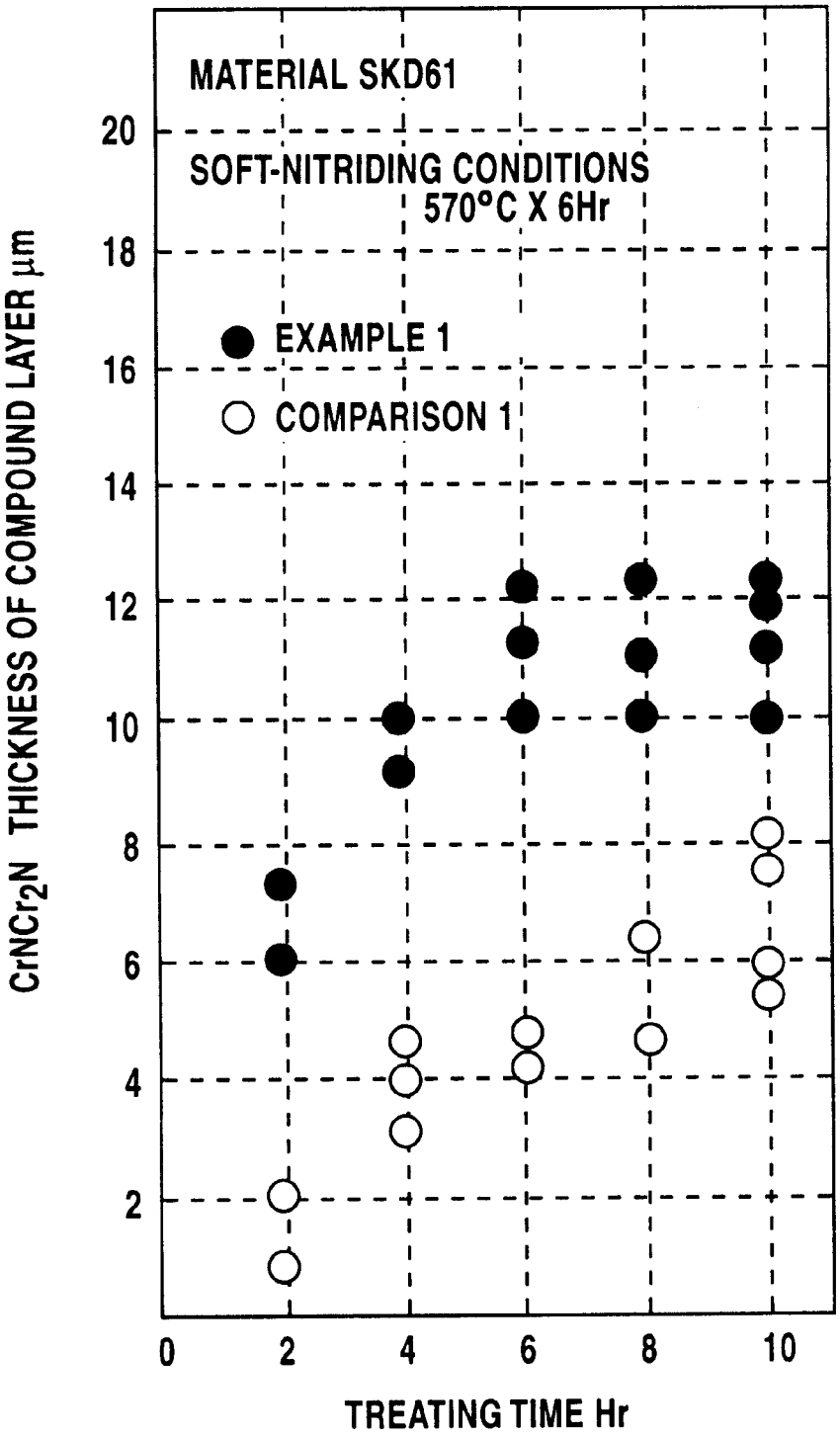
FIG. 3 is a graph showing a relationship between a treating time and the thickness of a chromium carbide nitride layer.

In addition, FIG. 3 shows b of Example 1 (see below Table 1) and Comparison 1 (see below Table 2).

[Nitriding treatment conditions]

Atmosphere: Fluorination+gas soft-nitriding treatment conjugated treatment ($NH_3$:$N_2$=75:25)

Temperature×time: gas soft-nitriding conjugated treatment: 570° C.×6 hours

Thickness of nitrogen compound layer: 12 to 15 μm

TABLE 1

SALT BATH TREATMENT CONDITIONS

| | EXAMPLE 1 | | |
|---|---|---|---|
| | a | b | c |
| Treating agent* (% by weight) | | | |
| A | 84.9899 | 81.99 | 69 |
| B | 15 | 17 | 20 |
| C | 0.01 | 1 | 10 |
| D | 0.0001 | 0.01 | 1 |
| E | — | — | — |
| Temperature (° C.) | 570 | 570 | 570 |
| Thickness of nitrogen compound layer (μm) | 12–15 | 12–15 | 12–15 |
| Thickness of chromium carbide nitride (μm)** | | | |
| 2 hours | 6–8 | 6–8 | 6–8 |
| 4 hours | 8–10 | 8–10 | 8–10 |
| 6 hours | 10–13 | 10–13 | 10–13 |
| 8 hours | 10–13 | 10–13 | 10–13 |
| 10 hours | 10–13 | 10–13 | 10–13 |

(NB)
A: $CaCl_2$:NaCl:$SiO_2$ = 5.4:2.6:2.0
B: Chromium powders (−150 mesh)
C: $CaC_2$:NaOH:CaO = 1:10:10
D: Metal powders of $CaH_2$ and Si
E: 52 mol % of $CaCl_2$ + 48 mol % of NaCl
*: Each value in % by weight of A to E is based upon the whole treating agent.
**: Each time means a treating time.

TABLE 2

SALT BATH TREATMENT CONDITIONS

| | COMPARATIVE EXAMPLE | | COMPARISON |
|---|---|---|---|
| | a | b | 1 |
| Treating agent (% by weight) | | | |
| A | 87.99495 | 57 | — |
| B | 12 | 23 | 20 |
| C | 0.005 | 15 | — |
| D | 0.00005 | 5 | — |
| E | — | — | 80 |
| Temperature (° C.) | 570 | 570 | 570 |
| Thickness of nitrogen compound layer (μm) | 12–15 | 12–15 | 12–15 |
| Thickness of chromium carbide nitride (μm) ** | | | |
| 2 hours | 2–3 | 2–3 | 1–2 |
| 4 hours | 5–6 | 5–6 | 3–5 |
| 6 hours | 6–7 | 6–7 | 4–5 |
| 8 hours | 7–8 | 7–8 | 5–7 |
| 10 hours | 8–9 | 8–9 | 5–8 |

(NB)
A: $CaCl_2$ : NaCl : $SiO_2$ = 5.4 : 2.6 : 2.0
B: Chromium powders (−150 mesh)
C: $CaC_2$ : NaOH : CaO = 1 : 10 : 10
D: Metal powders of $CaH_2$ and Si
E: 52 mol % of $CaCl_2$ + 48 mol % of NaCl
*: Each value in % by weight of A to E is based upon the whole treating agent.
**: Each time means a treating time.

As apparent from Tables 1, 2 and FIG. 3, it is seen that a thicker chromium carbide nitride layer is formed in Example 1 as compared with Comparative Example 1 and Comparison 1 at any point of time, In addition, in order to obtain a chromium carbide nitride layer having thickness of around 6 μm, it took longer than 4 hours in Comparative Example 1 and longer than 8 hours in Comparison 1 whereas it took about 2 hours in Example 1 and, thus, it is seen that a treating time can be reduced ½ to ⅓ as compared with comparative Example 1 and can be reduced to ⅓ to ¼ as compared with Comparison 1.

(2) A nitrogen-diffused layer

EXAMPLE 2

After fluorination and gas soft-nitriding conjugated treatment, the nitriding-treatment of diffusion-treatment under $N_2$ gas atmosphere was carried out using a test piece of SKDG61 material under the following conditions so as to form a nitrogen-diffused layer. Then, the salt bath treatment was conducted in the same conditions as in the Example 1.

[Nitriding treatment conditions]

Atmosphere: Fluorination+gas soft-nitriding conjugated treatment ($NH_3$:$N_2$=25:75)+diffusion treatment ($N_2$)

Temperature×time: gas soft-nitriding conjugated treatment: 500° C.×3 hours

: diffusion-treatment: 500° C.×0.75 hours

Thickness of nitrogen-diffused layer: 50 to 60 μm

As a result, a chromium-concentrated layer was formed in thickness almost the same as the chromium carbide nitride layer of the Example 1 and the same effect was obtained.

(3) A nitrogen-diffused layer

EXAMPLE 3

The nitriding-treatment was carried out using a test piece of SKD61 material under the same nitriding conditions as in the Example 1. Thus obtained nitrogen compound layer was deleted by shot peening so that the nitrogen diffused layer was remained. Then, the salt bath treatment was conducted in the same conditions as in the Example 1.

As a result, a chromium-concentrated layer was formed in thickness almost the same as the chromium carbide nitride layer of the Example 1 and the same effect was obtained.

(4) A nitrogen diffused layer

EXAMPLE 4

The nitriding-treatment was carried out using a test piece of SKD61 material under the same nitriding conditions as in the Example 1. Thus obtained nitrogen compound layer was deleted by immersion in acid so that the nitrogen diffused layer was remained. Then, the salt bath treatment was conducted in the same conditions as in the Example 1.

As a result, a chromium-concentrated layer was formed in thickness almost the same as the chromium carbide nitride layer of the Example 1 and the same effect was obtained.

(5) A nitriding layer+A chromium-plated layer.

EXAMPLE 5

The nitriding-treatment was carried out using a test piece of SKD61 material under the same nitriding conditions as in the Example 1 so that a chromium-plated layer in 15 μm thickness was formed on the surface of the formed nitrogen compound layer. Then, the salt bath treatment was conducted in the same conditions as in the Example 1.

As a result, a chromium carbide nitride layer was formed in thickness almost the same as the chromium carbide nitride layer of the Example 1 and the same effect was obtained.

(6) A nitride layer

EXAMPLE 6

COMPARATIVE EXAMPLE 2 AND COMPARISON 2

Figure 4:
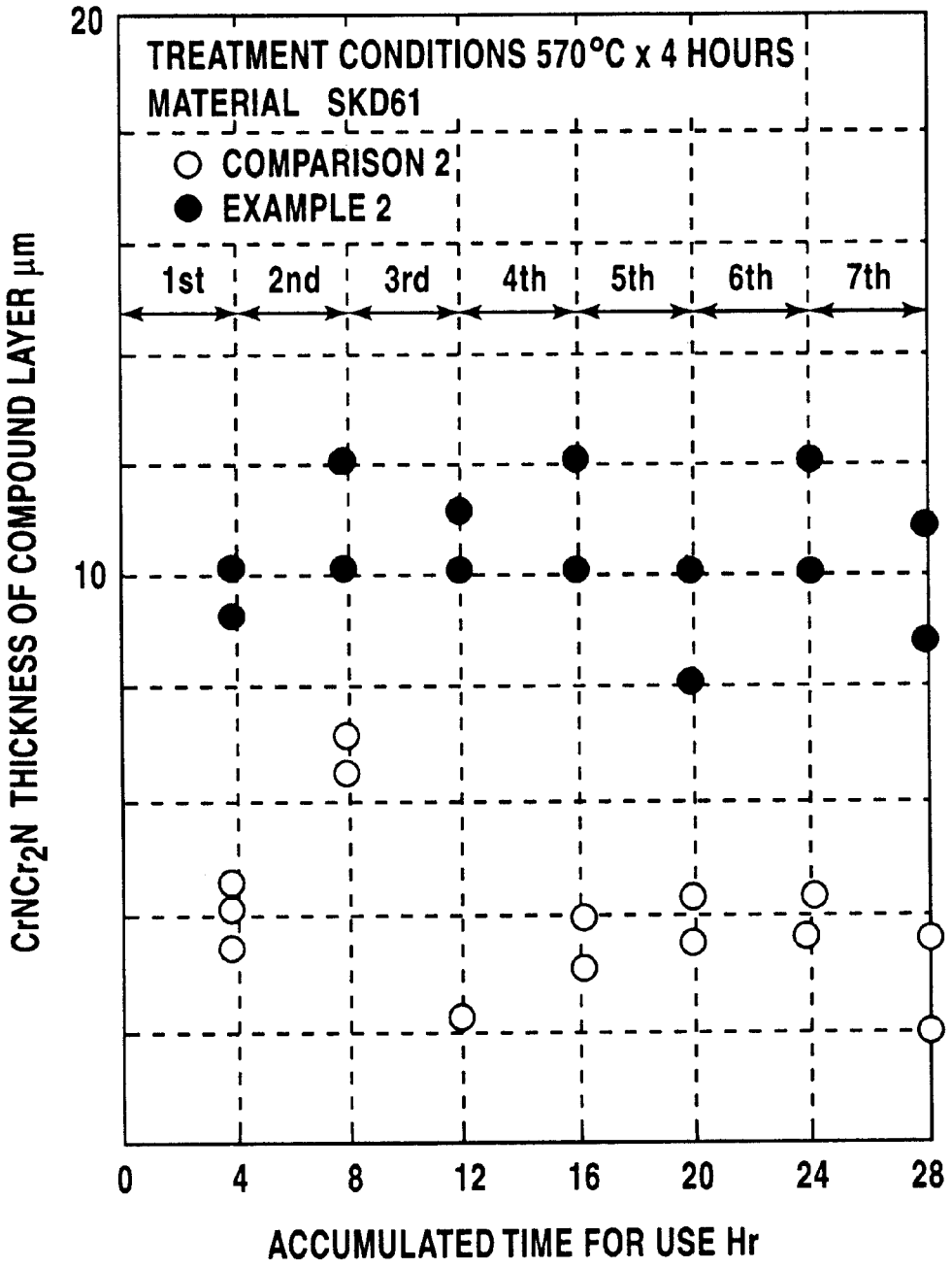
FIG. 4 is a graph showing a relationship between accumulated time for use of a salt bath and the thickness of a chromium carbide nitride layer.

The surface treatment of the present invention was carried out using a test piece of SKD61 material under the following conditions. In the salt bath treatment, the same salt bath was repeatedly used 7 times and the thickness of a chromium carbide nitride layer of a test piece which had been surface-treated by each charge was measured. A relationship between accumulated time for use and the thickness of a chromium carbide nitride layer is shown in FIG. 4. In addition, FIG. 4 shows b of Example 6 (see below Table 3) and Comparison 2 (see below Table 4)

[Nitriding treatment conditions]

Atmosphere: Fluorination+gas soft-nitriding conjugated treatment ($NH_3$:$N_2$=75:25)

Temperature×time: gas soft-nitriding conjugated treatment: 570° C.×6 hours

Thickness of nitrogen compound layer: 12 to 14 μm

TABLE 3

SALT BATH TREATMENT CONDITIONS

| | EXAMPLE 6 | | |
|---|---|---|---|
| | a | b | c |
| Treating agent* (% by weight) | | | |
| A | 84.9899 | 81.99 | 69 |
| B | 15 | 17 | 20 |
| C | 0.01 | 1 | 10 |
| D | 0.0001 | 0.01 | 1 |
| E | — | — | — |
| Temperature (° C.) | 570 | 570 | 570 |
| Thickness of nitrogen compound layer (μm) | 12–14 | 12–14 | 12–14 |
| Thickness of chromium carbide nitride (μm)** | | | |
| 1st time | 9–10 | 9–10 | 9–10 |
| 2nd time | 10–12 | 10–12 | 10–12 |
| 3rd time | 10–12 | 10–12 | 10–12 |
| 4th time | 10–12 | 10–12 | 10–12 |
| 5th time | 8–10 | 8–10 | 8–10 |
| 6th time | 10–12 | 10–12 | 10–12 |
| 7th time | 9–11 | 9–11 | 9–11 |

(NB)
A: $CaCl_2$:NaCl:$SiO_2$ = 5.4:2.6:2.0
B: Chromium powders (−150 mesh)
C: $CaC_2$:NaOH:CaO = 1:10:10
D: Metal powders of $CaH_2$ and Si
E: 52 mol % of $CaCl_2$ + 48 mol % of NaCl
*: Each value in % by weight of A to E is based upon the whole treating agent.

TABLE 4

SALT BATH TREATMENT CONDITIONS

| | COMPARATIVE EXAMPLE | | COMPARISON |
|---|---|---|---|
| | a | b | 2 |
| Treating agent * (% by weight) | | | |
| A | 87.99495 | 57 | — |
| B | 12 | 23 | 20 |
| C | 0.005 | 15 | — |
| D | 0.00005 | 5 | — |
| E | — | — | 80 |
| Temperature (° C.) | 570 | 570 | 570 |
| Thickness of nitrogen compound layer (μm) | 12–15 | 12–15 | 12–15 |
| Thickness of chromium carbide nitride (μ) ** | | | |
| 1st time | 5–7 | 5–7 | 3–5 |
| 2nd time | 8–9 | 8–9 | 6–7 |

TABLE 4-continued

| SALT BATH TREATMENT CONDITIONS | | | |
|---|---|---|---|
| | COMPARATIVE EXAMPLE | | COMPARISON |
| | a | b | 2 |
| 3rd time | 5–7 | 5–7 | 2–3 |
| 4th time | 5–7 | 5–7 | 3–4 |
| 5th time | 5–7 | 5–7 | 3–5 |
| 6th time | 5–7 | 5–7 | 3–5 |
| 7th time | 5–7 | 5–7 | 2–4 |

(NB)
A: $CaCl_2$ : NaCl : $SiO_2$ = 5.4 : 2.6 : 2.0
B: Chromium powders (−150 mesh)
C: $CaC_2$ : NaOH : CaO = 1 : 10 : 10
D: Metal powders of $CaH_2$ and Si
E: 52 mol % of $CaCl_2$ + 48 mol % of NaCl
*: Each value in % by weight of A to E is based upon the whole treating agent.

As apparent from Tables 3, 4, and FIG. 4, it is seen that the thickness of a chromium carbide nitride layer becomes extremely thin after third treatment in Comparison 2. To the contrary, it is seen that, in Example 6, a thicker chromium carbide nitride layer is totally formed as compared with Comparison 2 and, even when treatment is repeated to make accumulated time for use of a salt bath longer, a chromium carbide nitride layer having the approximately same thickness is stably formed. In addition, it is seen that, in Comparative Example 2, even when treatment is repeated to make accumulated time for use of a salt bath longer, a chromium carbide nitride layer having the approximately same thickness is stable formed, which, however, is thinner than Example 6.

(7) A nitride layer

EXAMPLE 7

A hot forging mold (crude mold, material; SKD61, after hardening and tempering treatment, matrix; high HRC47–50) was used and the surface treatment of the present invention was carried out under the following conditions.

[Nitriding treatment conditions]

Atmosphere: Fluorination+gas soft-nitriding conjugated treatment (RX gas: $NH_3$=1:1)

Temperature×time: gas soft-nitriding conjugated treatment: 570° C.×6 hours

Thickness of nitrogen compound layer: 11 to 13 μm

[Salt bath treatment conditions]

Treating agent: The same as in Example 1

Temperature×time: 570° C.×4 hours and, thereafter, air-cooling.

In the aforementioned treatment conditions, preparation of a salt bath was carried out as follows. That is, $CaCl_2$, NaCl and $SiO_2$ were mixed at a predetermined ratio, placed into a salt bath shown in FIG. 1, heated to melt at 570° C. in the atmosphere, chromium powders were added thereto while stirring a molten salt bath, and then carbide, hydroxide, hydride and oxide of an alkali metal and an alkaline earth metal as well as metal powders of Si, Mn and the like were added thereto. Then, basicity of the salt bath was checked by a steel foil test (a pure iron steel foil of thickness 0.01 mm×width 30 mm is immersed into a salt bath for 10 minutes and basicity of the salt bath is determined by its oxidized degree and lost of weight resulted from polishing. When basicity is low and oxidativeness is high, polishing of the steel foil is great. However, in the present invention, even after immersion, little abrasion of the steel foil is observed on appearances and treatment is conducted while maintaining the gloss) and the viscosity was adjusted.

In addition, a test piece of the same material was treated at the same charge where the aforementioned hot forging mold was treated. This was investigated and it was confirmed that a compound layer of 8 to 10 μm was formed and the compound layer is chromium carbide nitride [Cr (N,C), $Cr_2$ (N,C)] by X-ray diffraction.

The surface treated hot forging mold as described above was a mold for 2500 ton crank press and used for forging gears made of chromium-molybdenum steel. As a result, a life of a mold, the surface of which was hardened by ion-nitriding, in the prior art was about 3000 to 3500 times forging whereas up to about 6500 to 7000 pieces could be forged in the mold in Example 7, which resulted in an about two times life as compared with the ion-nitrided mold.

(8) A nitride layer

EXAMPLE 8

A screw head for rigid plastic injection molding (material; SKD61, after hardening and tempering treatment, matrix; high HRC 40–45)

[Nitriding treatment conditions]

Atmosphere: Gas soft-nitriding treatment (RX gas:$NH_3$=1:1)

Temperature×time: 570° C.×6 hours

Thickness of nitrogen compound layer: 11 to 12 μm

[Salt bath treatment conditions]

Treating agent: The same as in Example 2

Temperature×time: 570° C.×4 hours and, thereafter, air-cooling.

Figure 5:
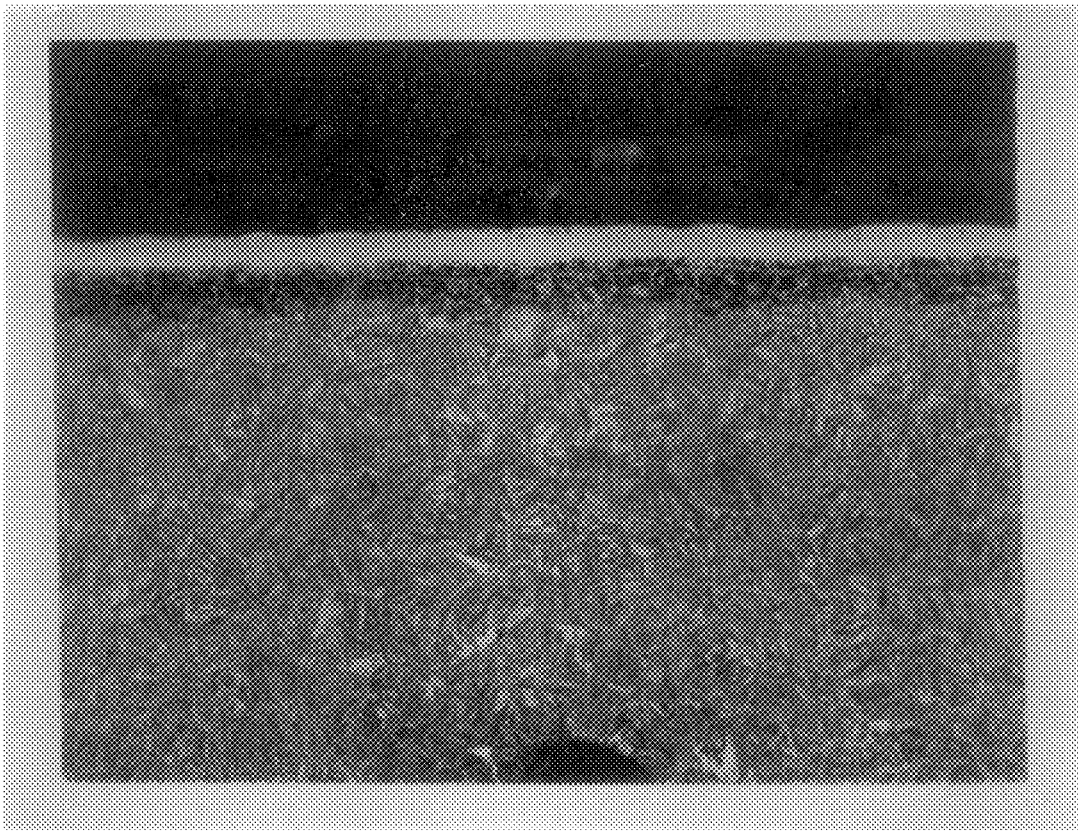
FIG. 5 is a cross-sectional microphotograph showing a chromium carbide nitride layer.
Figure 6:
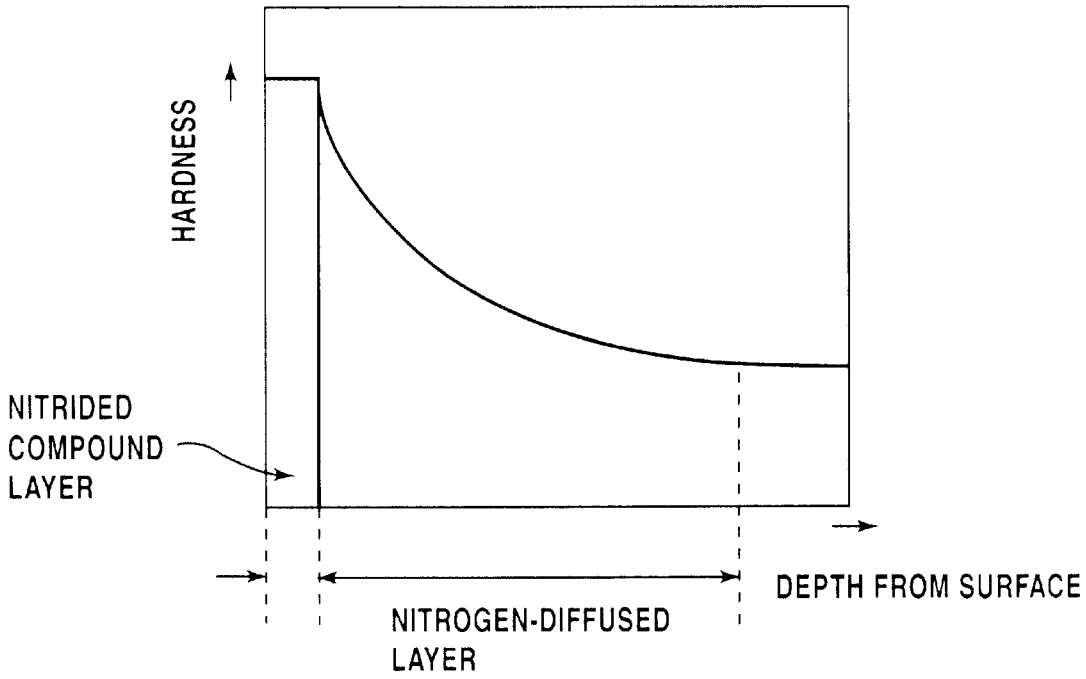
FIG. 6 is a graph showing a cross-sectional hardness distribution of the surface portion of a ferrous material on which a nitrided layer was formed.

A test piece of the same material was treated at the same charge, this was investigated and it was confirmed that a compound layer of 8 to 10 μm was formed and the compound layer was chromium carbide nitride [Cr (N,C), $Cr_2$ (N,C)] by X-ray diffraction. In addition, a cross-sectional microphotograph of the chromium carbide nitride layer is shown in FIG. 5. As apparent from FIG. 5, it is seen that a compact surface layer having no defects is formed and adhesion properties thereof are good.

The aforementioned surface-treated screw head is used for injection molding of a plastic containing glass fibers or the like and high resistance to wear is required. As a result, the treatment with carbide nitride such as TiC, N and the like was conducted by PVD (physical vapor deposition) and boron steel was used in the prior art, whereas the screw head in Example 8 showed superior resistance to wear and resistance to peeling over those of PVD-treated pieces, and a life was improved more than three times.

(9) A nitride layer

EXAMPLE 9

A casting hole plug for an aluminum die casting mold (material; SKD61) was used and the surface treatment of the present intention was conducted under the following conditions.

[Nitriding treatment conditions]

Atmosphere: Fluorination+gas soft-nitriding conjugated treatment (RX gas:$N_3$=1:1)

Temperature×time: gas soft-nitriding conjugated treatment: 570° C.×3 hours

Thickness of nitrogen compound layer: 10 to 15 μm

[Salt bath treatment conditions]

Treating agent: The same as in Example 1

Temperature×time: 570° C.×4 hours and, thereafter, air-cooling.

A test piece of the same material wias treated at the same charge and this was subjected to X-ray diffraction to confirm that a chromium carbide nitride [Cr (N,C), $Cr_2$ (N,C)] layer was formed.

The aforementioned casting hole plug is required to have high resistance to abrasion and resistance to wear. The prior art plug, the surface of which was hardened by ion-nitriding, had a life of about 150 shots whereas the casting hole plug of Example 9 had durability of not less than 450 shots, which could prolong a life more than three times as compared with the prior art.

(10) A nitride layer

EXAMPLE 10 AND COMPARATIVE EXAMPLE 3

Figure 9:
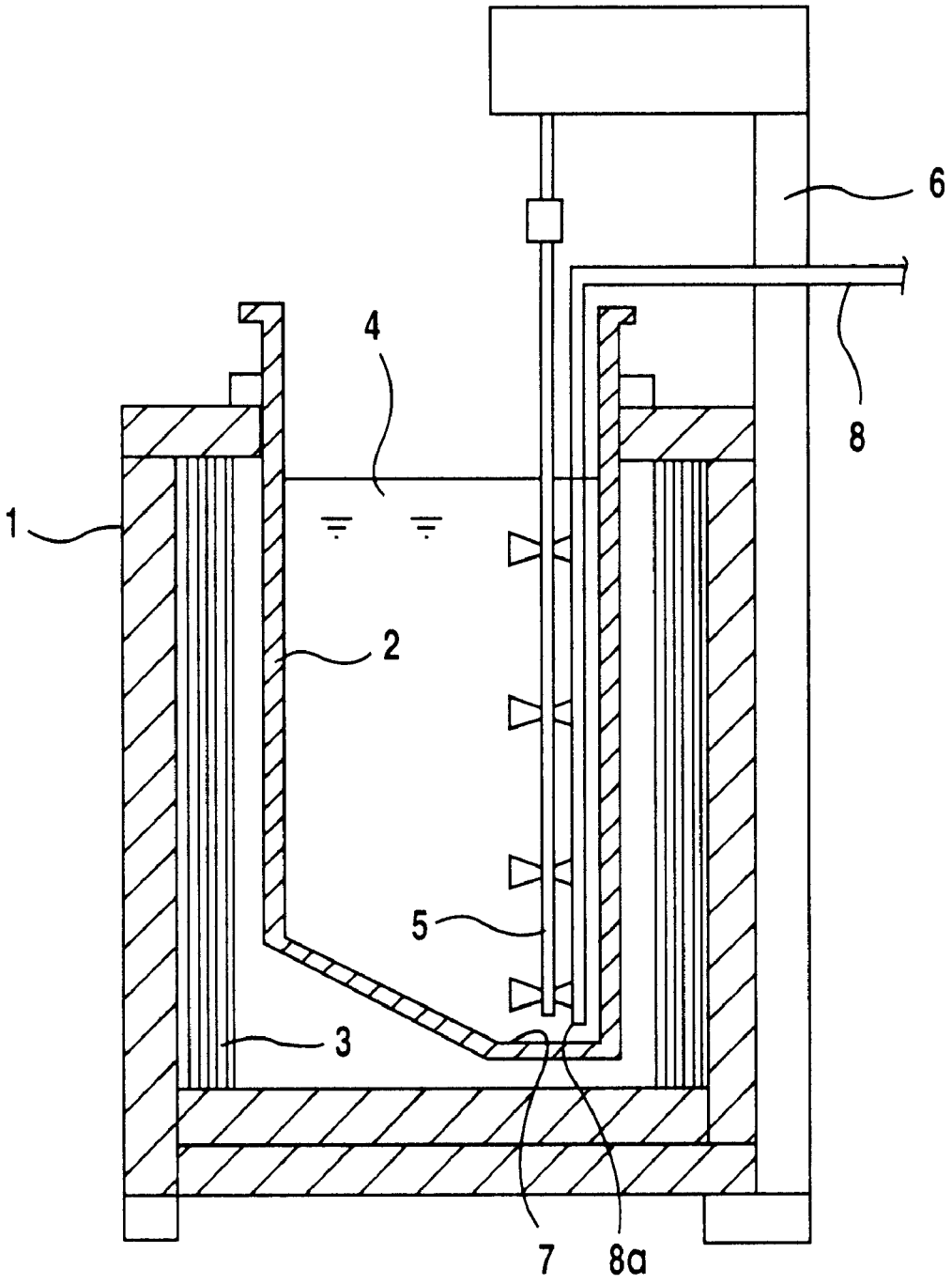
FIG. 9 is a cross-sectional view showing another salt bath of the present invention.
Figure 10:
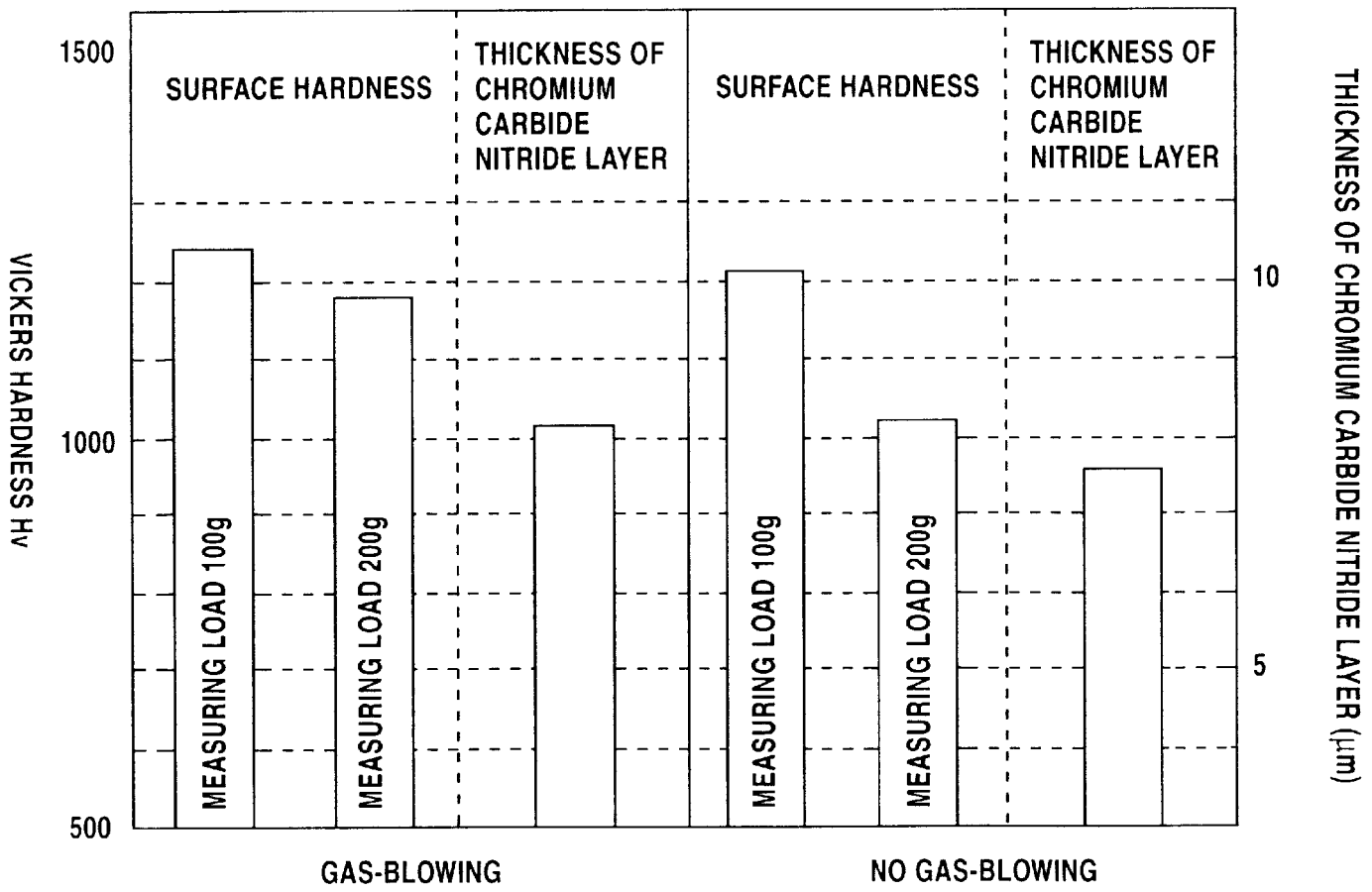
FIG. 10 is a graph showing an effect on the thickness and the surface hardness of a chromium carbide nitride layer by gas-blowing.

The salt bath furnace shown in FIG. 9 was used. In the salt bath furnace, a pipe for gas-blowing is arranged in such a manner that a gas blown-out hole 8*a* at the point of the pipe 8 is positioned at the deep portion 2 lower than the slant surface of the bottom of the treating cell shown in FIG. 1. Since an impeller 5 is unnecessary for stirring the treating agent 5 in this case, the impeller 5 and a means for holding the impeller 5 may not be installed, however, which may be installed, as shown in FIG. 9. The surface treatment of the present invention was carried out using a test piece of SKD61 material under the following conditions so as to check an effect on quality by gas-blowing into the salt bath treating agents each having the same compositions. The measurements of thickness and surface hardness of a chromium carbide nitride layer are shown in FIG. 10 and the measurements of surface roughness are shown in Table 1.

[Nitriding treatment conditions]

Atmosphere: Fluorination+gas soft-nitriding treatment conjugated treatment ($NH_3$:$N_2$=75:25)

Temperature×time: gas soft-nitriding treatment conjugated treatment: 570° C.×3 hours Thickness of nitrogen compound layer: 10 to 13 $\mu$m

[Salt bath treatment conditions; Example 10]

Treating agent: The same as in Example 1

Blowing gas: Nitrogen gas (3 liters/minute)+Hydrogen gas (1 liter/minute)

Temperature×time: 570° C.×6 hours

[Salt bath treatment conditions; comparison 3]

Treating agent: The same as in Example 1

Temperature×time: 570° C.×6 hours

TABLE 5

| | SURFACE ROUGHNESS |
|---|---|
| EXAMPLE 10 | 1.30 $\mu$m |
| COMPARISON 3 | 1.77 $\mu$m |

As apparent from FIG. 10, it is seen that surface hardness does not substantially decrease in Example 10 as measuring load increases, while surface hardness greatly decreases in Comparison 3. This shows the difference in density between both chromium carbide nitride layers. It is found that Example 10 has a denser chromium-concentrated construction than Comparison 3. On the other hand, as apparent from Table 5, surface roughness of Example 10 is smaller than Comparison 3. This shows gas-blowing restrained oxidation.

What is claimed is:

1. A method for treating a surface of a ferrous material, which comprises:

nitriding-treating the ferrous material to form a nitrided layer composed of at least one of iron nitride and iron carbide nitride on the surface thereof, and heating to maintain the ferrous material at a temperature of 500 to 700° C. in a molten salt bath of a treating agent (A), whereby chromium is diffused into the nitrided layer to form a compound layer composed of at least one of chromium nitride and chromium carbide nitride, wherein the treating agent (A) contains the following (a) as a main component and containing the following (b) and (c):

(a) at least one of alkali metal chloride and alkaline earth metal chloride;

(b) glass having silicone oxide as a main component; and (c) chromium.

2. A method for treating a surface of a ferrous material, which comprises:

nitriding-treating a ferrous material to form a nitrided layer composed of a nitrogen-diffused layer on the surface thereof and heating to maintain the ferrous material at a temperature of 500 to 700° C. in a molten salt bath of a treating agent (A), whereby chromium is diffused into the nitrided layer to form a chromium-concentrated layer, wherein the treating agent (A) contains the following (a) as a main component and containing the following (b) and (c): (a) at least one of alkali metal chloride and alkaline earth metal chloride; (b) glass having silicone oxide as a main component; and (c) chromium.

3. A method for treating a surface of a ferrous material according to claim 1, which comprises:

nitriding-treating a ferrous material to form a nitrided layer composed of at least one of iron nitride and iron carbide nitride on the surface thereof, forming a chromium-plated layer on a surface of the nitrided layer, and heating to maintain the ferrous material at a temperature of 500 to 700° C. in the treating agent (A), whereby chromium is diffused into the nitrided layer to form a compound layer composed of at least one of chromium nitride and chromium carbide nitride.

4. The method for treating a surface of a ferrous material according to any one of claims 1 to 3, wherein the content of the glass (b) having silicone oxide as a main component in the treating agent (A) is 1 to 40% by weight.

5. The method for treating a surface of a ferrous material according to claim 1, wherein the treating agent (A) further contains the following compound (B), (B) at least one selected from the group consisting of metal carbide, alkali metal carbide, alkaline earth metal carbide, alkali metal hydride, alkaline earth metal hydride, alkali metal hydroxide, alkaline earth metal hydroxide, alkali metal oxide, alkaline earth metal oxide and silicon powders.

6. The method for treating a surface of a ferrous material according to claim 5, wherein the compound (B) is at least one selected from the group consisting of metal carbide, alkali metal carbide, alkaline earth metal carbide, alkali metal hydride, alkaline earth metal hydride, alkali metal hydroxide, alkaline earth metal hydroxide, alkali metal oxide and alkaline earth metal oxide.

7. The method for treating a surface of a ferrous material according to claim 5, wherein the compound (B) is at least one selected from the group consisting of metal carbide, alkali metal carbide, alkaline earth metal carbide, alkali metal hydride, alkaline earth metal hydride, alkali metal oxide, alkaline earth metal oxide and silicon powders.

8. The method for treating a surface of a ferrous material according to claim 5, wherein at least one of alkali metal carbide, alkaline earth metal carbide, alkali metal hydroxide, alkaline earth metal hydroxide, alkali metal oxide and alkaline earth metal oxide among the compound (B) is contained at a total amount of 0.01 to 10% by weight.

9. The method for treating a surface of a ferrous material according to claim 5, wherein at least one of metal carbide, alkali metal hydride, alkaline earth metal hydride and silicon powders among the compound (B) is contained at a total amount of 0.0001 to 1% by weight.

10. The method for treating a surface of a ferrous material according to claim 1, wherein the nitriding-treatment comprises the steps of pre-heating to maintain the ferrous material in a fluoro-gas atmosphere to form a fluoride film on the surface thereof and heating to maintain the ferrous material in a nitriding atmosphere to form a nitrided layer.

* * * * *

UNITED STATES PATENT AND TRADEMARK OFFICE

CERTIFICATE OF CORRECTION

PATENT NO. : 6,328,818 B1 
DATED : December 11, 2001
INVENTOR(S) : Miyagi et al.

It is certified that error appears in the above-identified patent and that said Letters Patent is hereby corrected as shown below:

Title page,
Item [57], ABSTRACT,
Change "having silicone oxide" to be -- having silicon oxide --

Column 2,
Line 44, change "having silicone oxide" to be -- having silicon oxide --

Column 20,
Line 17, change "having silicone oxide" to be -- having silicon oxide --
Line 33, change "having silicone oxide" to be -- having silicon oxide --
Line 48, change "having silicone oxide" to be -- having silicon oxide --

Signed and Sealed this

Twenty-eighth Day of January, 2003

JAMES E. ROGAN
*Director of the United States Patent and Trademark Office*